US007562549B2

(12) United States Patent
Deriaz et al.

(10) Patent No.: US 7,562,549 B2
(45) Date of Patent: Jul. 21, 2009

(54) DEVICE AND METHOD FOR PRODUCING TOOTH-LIKE PROFILED SECTIONS ON WORKPIECES

(75) Inventors: Daniel Deriaz, Meilen (CH); Peter Geser, Staefa (CH)

(73) Assignee: Ernst Grob AG, Maennedorf (CH)

( * ) Notice: Subject to any disclaimer, the term of this patent is extended or adjusted under 35 U.S.C. 154(b) by 114 days.

(21) Appl. No.: 10/597,741

(22) PCT Filed: Feb. 6, 2004

(86) PCT No.: PCT/CH2004/000066

§ 371 (c)(1),
(2), (4) Date: Sep. 26, 2006

(87) PCT Pub. No.: WO2005/075125

PCT Pub. Date: Aug. 18, 2005

(65) Prior Publication Data

US 2007/0163320 A1 Jul. 19, 2007

(51) Int. Cl.
*B21B 15/00* (2006.01)
*B21B 27/02* (2006.01)

(52) U.S. Cl. ..... 72/102; 72/126; 72/107

(58) Field of Classification Search ..... 72/80, 72/95, 100, 102, 107, 110, 119, 122, 126, 72/76, 125, 112, 82–85; 29/893.32
See application file for complete search history.

(56) References Cited

U.S. PATENT DOCUMENTS

| | | | | |
|---|---|---|---|---|
| 2,991,672 | A * | 7/1961 | Meyer et al. | 72/100 |
| 3,675,454 | A | 7/1972 | Pratt | |
| 4,307,592 | A * | 12/1981 | Krapfenbauer | 72/95 |
| 5,001,916 | A * | 3/1991 | Schuler et al. | 72/96 |
| 5,339,669 | A * | 8/1994 | Cretin et al. | 72/108 |

* cited by examiner

*Primary Examiner*—Dana Ross
*Assistant Examiner*—Debra M Sullivan
(74) *Attorney, Agent, or Firm*—Greenblum & Bernstein P.L.C.

(57) ABSTRACT

A device and method for manufacture of workpieces having defined profiling. A device includes an axially moveable workpiece holder and at least one forming tool. There is a first drive structured and arranged to intermittently rotate the workpiece holder about a longitudinal axis of a workpiece held in the workpiece holder, and a second drive, separate from the first drive, structured and arranged to rotate the at least one forming tool to act periodically on the workpiece. The device also includes an electronic control operably connected to the first drive and the second drive, which controls intermittent rotational movement of the workpiece holder based upon the second drive. The at least one forming tool includes profiled wheels or rollers that are driven to continually rotate along a circular orbit that is oriented parallel or obliquely to the longitudinal axis of the workpiece.

20 Claims, 2 Drawing Sheets

DEVICE AND METHOD FOR PRODUCING TOOTH-LIKE PROFILED SECTIONS ON WORKPIECES

CROSS REFERENCE TO RELATED APPLICATIONS

This application is a National Stage entry under 35 U.S.C. 371 of International Application PCT/CH2004/000066, which was filed on Feb. 6, 2004, the disclosure of which is expressly incorporated by reference herein in its entirety.

BACKGROUND OF THE INVENTION

1. Field of the Invention

The present invention relates to an apparatus and method for producing workpieces having a defined profiling.

2. Discussion of Background Information

Impact rolling machines are conventionally used for the cold forming manufacture of cylindrical workpieces which are to be provided with profiled sections having a toothing-like geometry. The movements of the tools (i.e., the working motion, direction and advancement of the profiling wheels or rollers) and the movement of the workpiece (i.e., the axial advancement to the tools as well as the rotation of the workpiece) must be geometrically coordinated with one another in order to achieve the desired profiling with the corresponding dimensions and precision.

The working motion and advancing motion of the tools as well as the workpiece can generally be continuous, which can be realized by the coupling these movements by way of mechanical or electronic drives. However, for the production of a predefined straight or helical toothing, the workpiece should ideally be rotated discontinually or intermittently.

Such a movement can be achieved mechanically, for example, by way of a gearbox construction on the basis of the Maltese cross gearing. Such a gearing allows the generation of discontinuous rotation movements starting from a continuously rotating drive apparatus. The respective rotation steps or partitioning steps are thereby dependent on the geometry of the gearing as well as its gear ratio. As such, the partitioning steps to be achieved must be defined and the gearing accordingly developed and constructed on the basis thereof. Such a gearing and, therefore, the production installation are generally limited to a preselected workpiece tooth number.

Owing to these limitations, a separate gearing must be constructed for each different workpiece tooth number. This represents a relatively high complexity, which last but not least is also reflected in relatively high product cost and high retooling cost.

SUMMARY OF THE INVENTION

The present invention relates to an apparatus and method which allows for a simple adjustment of the partitioning steps in the rotation of workpieces, especially for workpieces to be machined with impact rolling machines.

In accordance with aspects of the invention, there is a device for the manufacture of cylindrical workpieces with defined profiling, the device having an axially translatable workpiece holder which is intermittently rotatable about the longitudinal axis as well as forming tools periodically acting on the workpiece. The device has at least one separate drive for the intermittent rotation of the workpiece holder, which drive is mechanically separate from the drive of the forming tools. This separate drive is connected with an electronic control, which controls the intermittent rotational movement of the workpiece holder depending on the drive of the forming tools. In this manner, the rotational position of the workpiece can be advantageously adjusted at will in dependence of the respective movement or position of the forming tools. As such, a precise profile geometry may be created over the whole length of the profiling of the workpiece. The location as well as the duration of the workpiece standstill during the forming tool contact can also be adjusted at will.

By using implementations of the invention, a profiling of workpieces can be carried out at a significantly higher rotation speed than with the conventional mechanical connection of the drives. These significantly higher rotations speeds are possible because the electronically controlled drive has a significantly smaller mass inertia compared to the mechanical gearings previously used to create the intermittent rotational movement of the workpiece. The toothing specific optimal parameters for the geometry of the toothing can also be adjusted significantly quicker. A higher production rate at lower installation cost and production cost is thereby achieved.

In embodiments, the forming tools are preferably profiled wheels or rollers which are driven to continuously revolve along an orbit. The orbit is oriented, preferably adjustably, parallel to or at an angle in relation to the longitudinal axis of the workpiece. The electronic control of the intermittent rotation of the workpiece has proven especially advantageous for the forming processes used on impact rolling machines.

In further embodiments, the workpiece holder is supported in a headstock that is guided and movable in parallel to the workpiece axis. The headstock is connected with a drive by way of a coupling that is elastic at least in an axial direction. The drive thereby preferably remains free of the forces of the forming tools acting on the workpiece and, despite the high forming forces, can guarantee an exact positioning or intermittent rotation. The drive is preferably positioned in a secondary headstock that is also guided and moveable parallel to the workpiece axis. The secondary headstock can thereby be positioned either in the same guide as the headstock of the workpiece holder or in a separate guide oriented parallel thereto.

In even further embodiments, the periodic movement of the forming tools, the intermittent rotational movement of the workpiece holder, and the axial advancement of the workpiece holder have separate drive units which are electronically coupled with one another and preferably connected with the electronic control. In this manner, a very large potential variability of the movements is achieved and the manufacture of even complicated profile geometries enabled. Such a device is especially suited for the generation of profilings or toothings which extend obliquely relative to the longitudinal axis.

In additional embodiments, the workpieces are preferably solid or hollow. That is to say, the device in accordance with the invention is suitable for the working of both solid parts as well as hollow parts. Exterior as well as interior profilings or toothings can thereby be produced on hollow parts.

For example, in a specific embodiment, hollow workpieces are mounted on a cylindrical mandrel, which has a profiled (e.g., longitudinally profiled) surface.

In accordance with further aspects of the invention, there is a method for the production of cylindrical workpieces having a defined profiling. The method utilizes an axially movable workpiece holder for workpieces, which is intermittently rotatable about the longitudinal axis, as well as forming tools which periodically act on the workpiece. In the method, the workpiece is rotated about its longitudinal axis or stopped by way of an electronic control and a drive separate from the forming tools. This is carried out in accordance with the invention in dependence of the movement of the forming tools for the generation of a predetermined defined profiling geometry.

In embodiments, the control imposes on the workpiece left and right hand rotation as well as a standsill. The desired profiling geometry can thereby be very exactly achieved according to the geometry and movement of the forming tools.

In further embodiments, the control also controls the drives and the advancement movement of the forming tools according to preselected settings, as well as the axial advancement movement of the workpiece. The whole manufacturing process of the profiling of the cylindrical workpieces can thereby be easily controlled and easily adapted to different workpieces. For example, the respective gearings need not be labour intenstively newly adjusted or converted on the basis of different partitioning numbers for different workpieces.

Furthermore, implementations of the invention may be used for the manufacture of helical toothings on cylindrical workpieces.

According to a first aspect of the invention there is a device for the manufacture of workpieces having defined profiling. The device comprises an axially moveable workpiece holder and at least one forming tool. The device further comprises a first drive structured and arranged to intermittently rotate the workpiece holder about a longitudinal axis of a workpiece held in the workpiece holder, and a second drive, separate from the first drive, structured and arranged to rotate the at least one forming tool to act periodically on the workpiece. Lastly, the device comprises an electronic control operably connected to the first drive and the second drive, which controls intermittent rotational movement of the workpiece holder based upon the second drive. The at least one forming tool comprises profiled wheels or rollers that are driven to continually rotate along a circular orbit that is oriented parallel or obliquely to the longitudinal axis of the workpiece. The circular orbit may be adjustably oriented.

In embodiments, there is a headstock supporting the workpiece holder. The headstock may be guided and moveable in parallel to the longitudinal axis and connected to the first drive by a coupling that is elastic in an axial direction. Moreover, there may be a secondary headstock that is guided and moveable parallel to the longitudinal axis, and in which the first drive is positioned.

In further embodiments, the device comprises a third drive structured to axially advance the workpiece holder along the longitudinal axis, wherein the first, second and third drives are electronically coupled to one another. The first, second and third drives may be connected with the electronic control.

In additional implementations, the workpiece is a cylindrical solid or hollow body. Furthermore, one end of the workpiece holder may be comprised of a cylindrical mandrel on which the workpiece is mounted. The cylindrical mandrel has a profiled surface or a longitudinally profiled surface. Moreover, the device may be structured and arranged to manufacture helical toothings on cylindrical workpieces.

According to another aspect of the invention, there is a method for manufacturing workpieces having defined profiling, the method comprising: intermittently rotating an axially moveable workpiece holder about a longitudinal axis of a workpiece held in the workpiece holder; periodically acting on the workpiece with at least one forming tool; and controlling, with an electronic control, a first drive that causes the intermittent rotating and a second drive that causes movement of the at least one forming tool. The at least one forming tool comprises profiled wheels or rollers that are driven to continually rotate along a circular orbit that is oriented parallel or obliquely to the longitudinal axis of the workpiece.

The electronic control controls the first drive based upon the movement of the forming tools. Moreover, the rotating, the acting on, and the controlling may generate a predetermined defined profiling geometry on the workpiece. Furthermore, the electronic control may cause left hand rotation, right hand rotation, or standstill of the workpiece.

Still further, the electronic control may control the second drive and advancement of the forming tools according to preselected settings. The electronic control controls axial advancement of the workpiece. When the workpiece is cylindrical, the rotating, the acting on, and the controlling generate helical toothings on the workpiece.

According to another aspect of the invention, there is a device for the manufacture of workpieces having defined profiling, the device including an axially moveable workpiece holder and at least one forming tool. The device further comprises a first drive structured and arranged to intermittently rotate the workpiece holder about a longitudinal axis of a workpiece held in the workpiece holder, a second drive, separate from the first drive, structured and arranged to rotate the at least one forming tool to act periodically on the workpiece, and a third drive structured and arranged to axially advance the workpiece holder along the longitudinal axis. The first, second, and third drives are electronically coupled with one another and connected with an electronic control which controls intermittent rotational movement of the workpiece holder.

BRIEF DESCRIPTION OF THE DRAWINGS

An exemplary embodiment of the present invention is further described in the following by way of the figures, in which.

DETAILED DESCRIPTION OF THE PRESENT INVENTION

Figure 1:
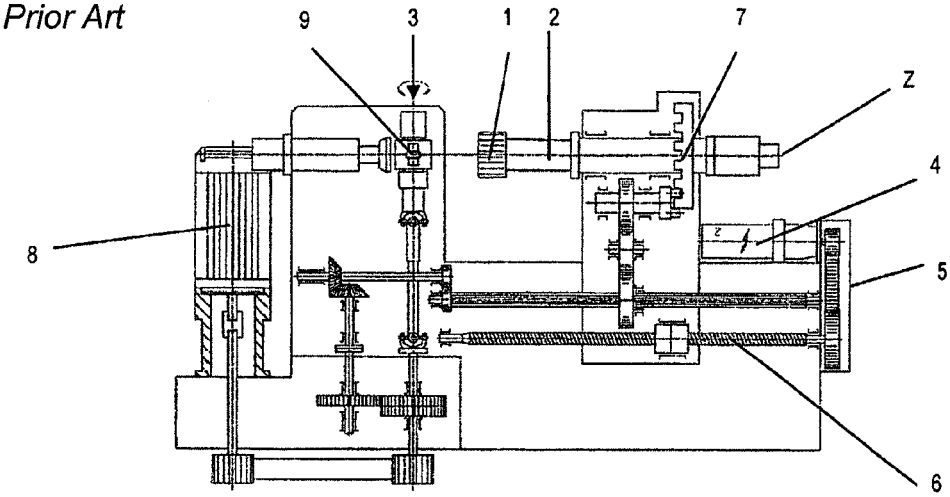
Fig. 1 Prior Art
FIG. 1 shows a longitudinal section through a conventional machining apparatus with mechanically coupled gearings.

FIG. 1 shows a longitudinal section through a conventional impact rolling machine for the machining of cylindrical pieces 1.

The workpiece 1 sits on a workpiece holder 2, which is advanceable along its axis z into the machining region 3. The advancement is carried out, for example, by way of an individual drive 4, which drives a spindle 6 through a gearing 5.

The forming tools 9, which are driven by drive 8, are mechanically directly connected through a Maltese cross type gearing 7 with the workpiece holder 2. The intermittent rotation about the axis z of the workpiece holder 2 is thereby directly coupled or synchronized with the movement of the forming tools 9 according to the design of the gear ratio and the Maltese cross type gearing 7. On the basis of this design, a defined profile can be machined into the surface of the workpiece 1 by the forming tools 9.

With this arrangement, only one profile can be produced having a specific profile or tooth number. For a different tooth number, the gear ratio between the drive 8 and the workpiece holder 2 must be adjusted, which can only be carried out by exchange of the corresponding gears or gearing parts. Such an exchange is time consuming and very cost intensive.

Figure 2:
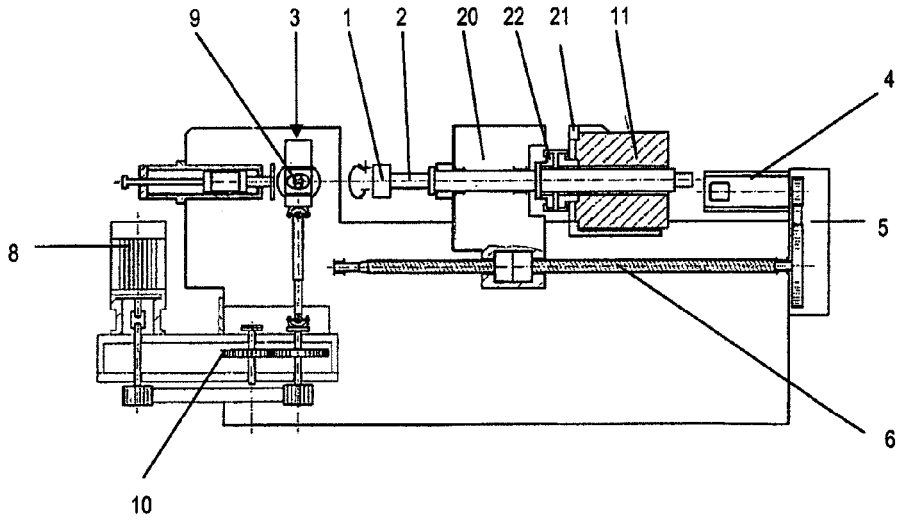
FIG. 2 shows a schematic longitudinal section through a device in accordance with the invention with an electronically coupled rotational drive of the workpiece.

A longitudinal section through a device in accordance with aspects of the invention is schematically illustrated in FIG. 2.

The construction and drive mechanism of the machining region 3 corresponds to the known construction as illustrated in FIG. 1. The drive 8 is connected with the forming tools 9 by way of a mechanical gearing 10.

However, the workpiece holder 2 with the workpiece 1 now has its own drive 11. The advancement of the workpiece 1 occurs through a separate drive 4 with gearing 5 and spindle 6, whereby the drive 11 is advanced together with the workpiece 1 or the workpiece holder 2.

The synchronization between the intermittent rotational movement of the workpiece holder 2 (and thereby the workpiece 1) and the forming tools 9 (or the drive 8) is carried out electronically by way of a control. The drive 8 as well as the drive 11 thereby preferably have corresponding position sensors.

With such electronic synchronization, the control can be quickly, individually and easily adjusted according to the settings of the profile partitioning, without the need for intervention in the impact rolling machine. By using implementations of the invention, movement sequences (i.e., special rotation patterns of workpiece 1) can be achieved which cannot be realized (or are only realizable at large operating expense) with a mechanical gearing. Such movement sequences are necessary, for example, for the impact rolling of helical toothings. Furthermore, the use of tools provided with a recallable coding or programming allows for an especially easy adjustment or programming of the control of the machine so that a manual adjustment is practically obviated.

In embodiments, the workpiece holder 2 is supported in a headstock 20 guided and movable in parallel to the workpiece axis Z and connected with the separate drive 11 by way of a coupling 22 elastic in axial direction. The separate drive 11 is preferably positioned in a secondary headstock 21 also guided and moveable parallel to the workpiece axis Z.

Figure 3:
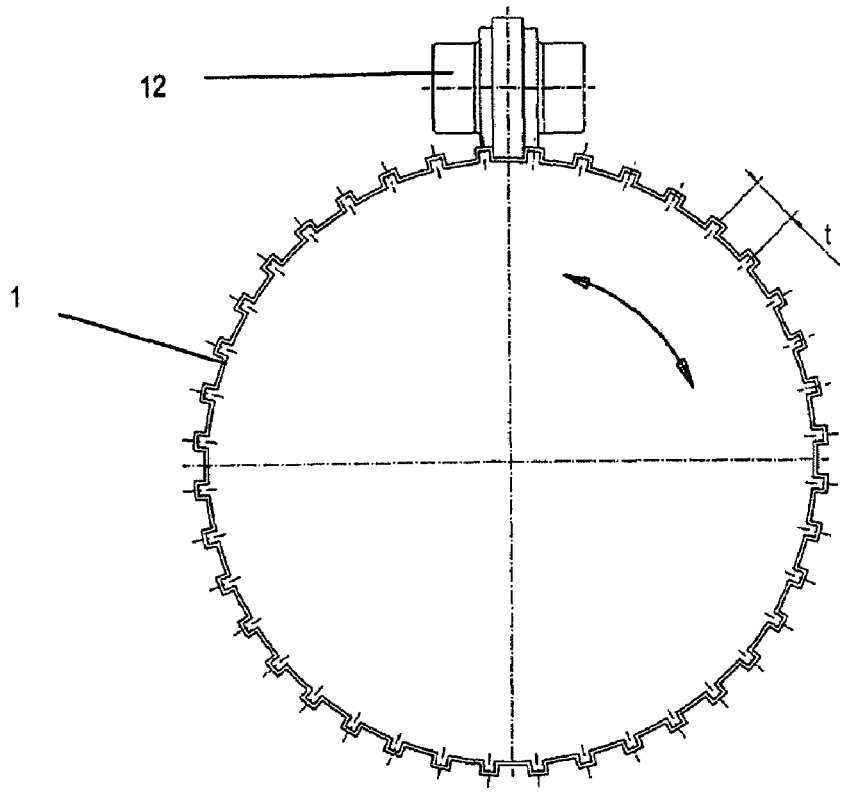
FIG. 3 shows a schematic front view of a workpiece with an engaged forming tool.

FIG. 3 schematically illustrates a front view of a workpiece 1 engaged by a machining tool in the form of a profile wheel 12. The profile wheel 12 is illustrated at its actual maximal penetration depth into the surface of the workpiece 1. According to the profile of the profile wheel 12, a profiling of the workpiece surface is achieved at a spacing t which is defined as profile division.

Figure 4:
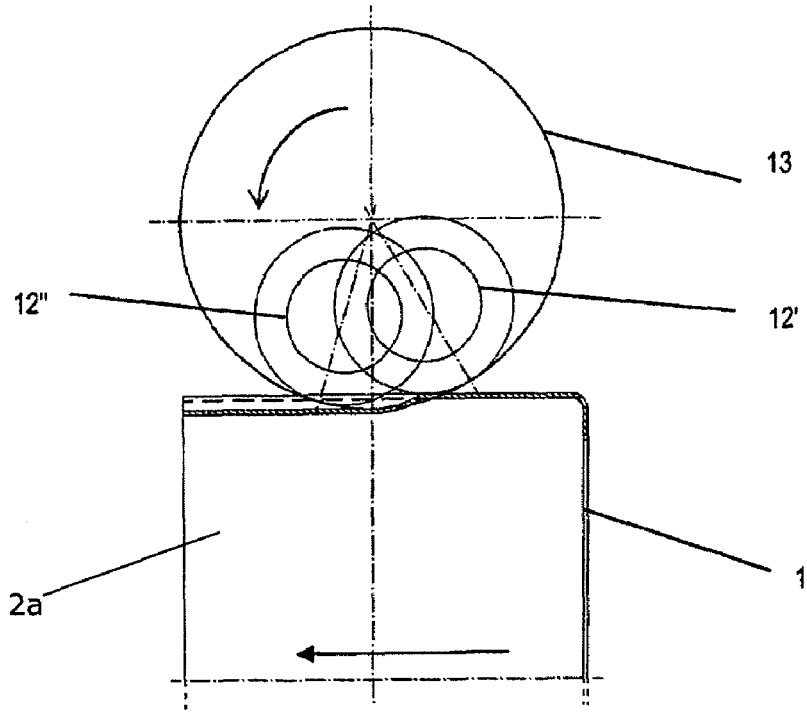
FIG. 4 shows schematically the longitudinal section through the engagement region of the forming tool on the workpiece according to FIG. 3.

This region is fully illustrated in longitudinal section in FIG. 4, from which it is apparent that the profile wheel 12 is guided along a circular orbit, where the circle 13 represents the orbit of the outermost regions of the profile wheel 12. The profile wheel is illustrated at its exit position 12' where it just leaves the surface of the workpiece 1, as well as in the approach position 12" in which the forming action on the workpiece 1 is commenced and the profile wheel enters the region of the profile just formed. The workpiece 1 must remain still between these two positions so that the desired profile shape can be exactly achieved. The workpiece 1 must be rotated by the profile division t during the following revolution of the profile wheel 12 about its orbit in order to achieve a profiling over the whole circumference. This standstill phase can be achieved in accordance with aspects of the invention exactly by the separate drive and the electronic synchronization, and can be easily adapted to the number of teeth to be generated, especially with respect to the location and duration of the workpiece standstill.

FIG. 4 further illustrates that the workpiece 1 is mounted on a cylindrical mandrel 2*a* which is comprised by the workpiece holder at an end of the workpiece holder and which has a longitudinally profiled surface.

In embodiments of the invention, high production rate can be achieved through high rotation speeds during the manufacture of such profiles in hollow cylindrical sheet steel parts. The adjustments critical for the profile geometry can be carried out quickly and easily by way of the corresponding control. These adjustments are preferably carried out automatically with the use of chip coded tools and, for example, activate without manual intervention a program already contained in the control.

With the conventional devices (and especially in such hollow parts), differently high pressure is generated by the profile wheels 12 on the flanks of the profiling by the rotation and advancement along the longitudinal axis of the workpiece. However, in devices in accordance with aspects of the invention with electronic synchronization and independent rotation drive, this effect can be practically eliminated by a corresponding compensation rotation about the longitudinal axis of the workpiece 1. With mechanical solutions, this could generally only be carried out at high expense, and even then not completely.

In further embodiments, a helical toothing can also be realized with the impact rolling tools, for example, by way of the individual controllability of the intermittent rotation of the workpiece.

Furthermore, the construction in accordance with aspects of the invention with electronically coupled drive also allows the use of the same machine for pressure rolling with pressure wheels, whereby an intermittent rotation of the workpiece is not necessary. Rather, the workpiece is rotatably driven with a predetermined, generally very high constant rotation speed. The retooling of the mechanical gearing necessary with the conventional devices is thereby obviated, since it can instead be easily adjusted and carried out electronically by way of the control according to aspects of the invention. This pressure rolling process renders it possible to first preform from a disk a thin-walled hollow part on a pressure mandrel and to then subsequently tooth it on the same pressure mandrel in the same process step.

The invention claimed is:

1. A device for the manufacture of workpieces having defined profiling, the device comprising:

an axially moveable workpiece holder;

at least one forming tool;

a first drive structured and arranged to intermittently rotate the workpiece holder about a longitudinal axis of a workpiece held in the workpiece holder;

a second drive, separate from the first drive, structured and arranged to rotate the at least one forming tool to act periodically on the workpiece; and an electronic control operably connected to the first drive and the second drive, which controls intermittent rotational movement of the workpiece holder based upon the second drive, wherein the at least one forming tool comprises profiled wheels or rollers that are driven to continually rotate along a circular orbit that is oriented parallel or obliquely to the longitudinal axis of the workpiece.

2. The device according to claim 1, wherein the circular orbit is adjustably oriented.

3. The device according to claim 1, further comprising a headstock supporting the workpiece holder.

4. The device according to claim 3, wherein the headstock is guided and moveable in parallel to the longitudinal axis and connected to the first drive by a coupling that is elastic in an axial direction.

5. The device according to claim 4, further comprising a secondary headstock that is guided and moveable parallel to the longitudinal axis, and in which the first drive is positioned.

6. The device according to claim 1, further comprising a third drive structured to axially advance the workpiece holder along the longitudinal axis, wherein the first, second and third drives are electronically coupled to one another.

7. The device according to claim 6, wherein the first, second and third drives are connected with the electronic control.

8. The device according to claim 1, wherein the workpiece is a cylindrical solid or hollow body.

9. The device according to claim 1, wherein one end of the workpiece holder is comprised of a cylindrical mandrel on which the workpiece is mounted.

10. The device according to claim 9, wherein the cylindrical mandrel has a profiled surface.

11. The device according to claim 10, wherein the cylindrical mandrel has a longitudinally profiled surface.

12. The device according to claim 1, wherein the device is structured and arranged to manufacture helical toothings on cylindrical workpieces.

13. A method for manufacturing workpieces having defined profiling, comprising:

intermittently rotating an axially moveable workpiece holder about a longitudinal axis of a workpiece held in the workpiece holder;

periodically acting on the workpiece with at least one forming tool; and controlling, with an electronic control, a first drive that causes the intermittent rotating and a second drive that causes movement of the at least one forming tool, wherein the at least one forming tool comprises profiled wheels or rollers that are driven to continually rotate along a circular orbit that is oriented parallel or obliquely to the longitudinal axis of the workpiece.

14. The method of claim 13, wherein the electronic control controls the first drive based upon the movement of the forming tools.

15. The method of claim 13, wherein the rotating, the acting on, and the controlling generate a predetermined defined profiling geometry on the workpiece.

16. The method of claim 13, wherein the electronic control causes left hand rotation, right hand rotation, or standstill of the workpiece.

17. The method of claim 13, wherein the electronic control controls the second drive and advancement of the forming tools according to preselected settings.

18. The method according to claim 17, wherein the electronic control controls axial advancement of the workpiece.

19. The method of claim 13, wherein the workpiece is cylindrical, and the rotating, the acting on, and the controlling generate helical toothings on the workpiece.

20. A device for the manufacture of workpieces having defined profiling, the device comprising:

an axially moveable workpiece holder;

at least one forming tool;

a first drive structured and arranged to intermittently rotate the workpiece holder about a longitudinal axis of a workpiece held in the workpiece holder;

a second drive, separate from the first drive, structured and arranged to rotate the at least one forming tool to act periodically on the workpiece; and a third drive structured and arranged to axially advance the workpiece holder along the longitudinal axis, wherein the first, second, and third drives are electronically coupled with one another and connected with an electronic control which controls intermittent rotational movement of the workpiece holder.

* * * * *